US005090716A

United States Patent [19]

Borden

[11] Patent Number: 5,090,716

[45] Date of Patent: Feb. 25, 1992

[54] EXTENDED ELEVATED FOOT PLATFORM

[76] Inventor: Kermit M. Borden, 2125 Whitney Ave., Apt. 3A, New Orleans, La. 70114

[21] Appl. No.: 323,807

[22] Filed: Mar. 15, 1989

[51] Int. Cl.[5] ..... A63C 17/02

[52] U.S. Cl. ..... 280/87.042; 280/87.043; D21/227

[58] Field of Search ..... 280/87.01, 87.021, 87.03, 280/87.041, 87.042, 87.043; D21/227

[56] References Cited

U.S. PATENT DOCUMENTS

| | | | |
|---|---|---|---|
| D. 224,424 | 7/1972 | Schell | 280/87.042 |
| 3,309,104 | 3/1967 | Gold | 280/87.041 |
| 4,088,334 | 5/1978 | Johnson | 280/87.042 |
| 4,168,076 | 9/1979 | Johnson | 280/87.042 |
| 4,183,547 | 1/1980 | Cohen et al. | 280/87.042 |
| 4,195,857 | 4/1980 | Hechinger | 280/87.042 |

*Primary Examiner*—Charles A. Marmor
*Assistant Examiner*—Eric Culbreth
*Attorney, Agent, or Firm*—Browdy and Neimark

[57] ABSTRACT

The Extended Elevated Foot Platform (EEFP) is an invention that is attached to the rear of a conventional skatingmobile. It is comprised of a pivoting arm, pivoting arm assembly, foot platform, pivoting pin, pivot pin keeper and foot brake. The rider of a skatingmobile is able to propel the skatingmobile by standing on the EEFP, holding onto the handle bar of the skatingmobile and shifting his weight from side to side, thereby negating the need to push off the ground for propulsion.

14 Claims, 2 Drawing Sheets

EXTENDED ELEVATED FOOT PLATFORM

The Extended Elevated Foot Platform (EEFP) is an invention that is attached to the rear of a conventional skatingmobile. It (the EEFP) represents an improvement and advancement on the use and utility of the skatingmobile by giving the rider more versatility in the method of propelling himself and the skatingmobile. The rider of a skatingmobile is able to propel the skatingmobile by standing on the EEFP, holding onto the handle bar of the skatingmobile and shifting his weight from side to side, thereby negating the need to push off the ground for propulsion.

FIG. 1 is a top view of both the EEFP and the skating mobile on which it is attached. This is from an actual model made by inventor called "Big Foot".

FIG. 2 is a side view of both the EEFP and the skatingmobile on which it is attached.

The EEFP consists of, a pivot pin keeper, pivoting arm assembly, a pivot pin, a pivoting arm, a metal spring, a foot brake, wheels and a foot platform. In the instant invention the pivot pin keeper, pivoting arm assembly, pivot pin, pivoting arm, foot brake and spring are made of metal. The wheels are the same type of wheels that ar used on conventional roller skates. The foot platform is wood. The inventor acknowledges that other materials may be used or substituted to create the same result.

The purpose of the pivoting pin keeper is to hold the pivot in place when the rider is standing on the EEFP foot platform. When the rider is using the skatingmobile in the conventional manner (i.e., one foot on the skatingmobile foot platform holding on to the handle bar with both hands and propelling the skatingmobile by pushing one foot on the ground), the pivot pin is inserted in the pivoting arm through a hole that runs through the foot platform of the skatingmobile through the pivoting arm, thereby preventing any lateral movement of the pivoting arm and concomitantly the EEFP.

The function of the pivoting arm assembly is to connect the EEFP to the rear of the skatingmobile. This is accomplished by a screw that goes from the pivoting arm assembly through the floor of the foot platform of the skatingmobile, through a hole in the pivoting arm and is held intact by a nut that goes under the pivoting arm and attaches to the screw in the conventional nut/-screw relationship.

The pivoting arm is a elongated arm, that is attached to the pivoting arm assembly and the foot platform of the EEFP. The pivoting arm is bent at such an angle that when the rider steps on the foot platform of the EEFP the front wheels of the skatingmobile rise off the ground. Thus the wheels of the EEFP and the rear wheels of the skatingmobile are on the ground and the front wheels of the skating mobile are off of the ground. This also causes the handle bar to tilt slightly towards the rear allowing the rider easy access to the handle bars.

The metal spring and the foot brake act in concert with one another. The purpose of the metal spring is to stabilize the foot brake and prevent it from wobbling from side to side when pressure is applied. The metal spring is attached under the pivoting arm and is at such an angle as to touch to screw in the foot brake, between the two adjusting nuts.

The foot brake consists of a long metal screw that goes from the foot platform of the EEFP through the pivoting arm. There is one spring around the long screw above the foot platform. Additionally there are two nuts for adjusting the screw below the second spring and a conventional skating brake as found on the front of conventional roller skates. When the rider steps on the portion of the foot brake above the pivoting arm the skating brake touches the ground causing the EEFP to stop. The springs give guidance to the long screw and allow an even descent. The metal spring adds additional stability allowing a smooth and even braking experience. Because of the two nuts under the pivoting arm, as the skating brake wears down the rider can adjust the skating brake so the long screw never touches the ground.

The wheels of the EEFP are the same kind of wheels as found on conventional roller skates.

The advantages of the EEFP is the ability of the rider to propel himself without having to push off the ground. The rider standing on the EEFP can hold onto the handle bars and by swaying from side to side and shifting his weight from side to side cause the entire skatingmobile to move forward. Additionally the EEFP gives to rider two toys in one; it can operate as a conventional skatingmobile when the pivoting pin is in place or when the pivoting pin is not in place the rider can function much like he is on a skate board. Unlike a conventional skatingmobile the EEFP allows the rider to do figure 8's and can be operated in a very small area.

It is an object of this invention to provide a novel toy that is fun and versatile. It is another object to this invention to provide a toy that can be used in a small or confined area if necessary.

It is a further object of this invention to provide a toy having the advantages set forth above.

Other objects will appear hereinafter.

For the purpose of illustrating the invention there is shown in the drawings a form of the invention which is preferred; it being understood, however, that this invention is not limited to the precise arrangements and instrumentalities shown.

DETAILED DESCRIPTION OF ILLUSTRATED EMBODIMENT

Figure 1:
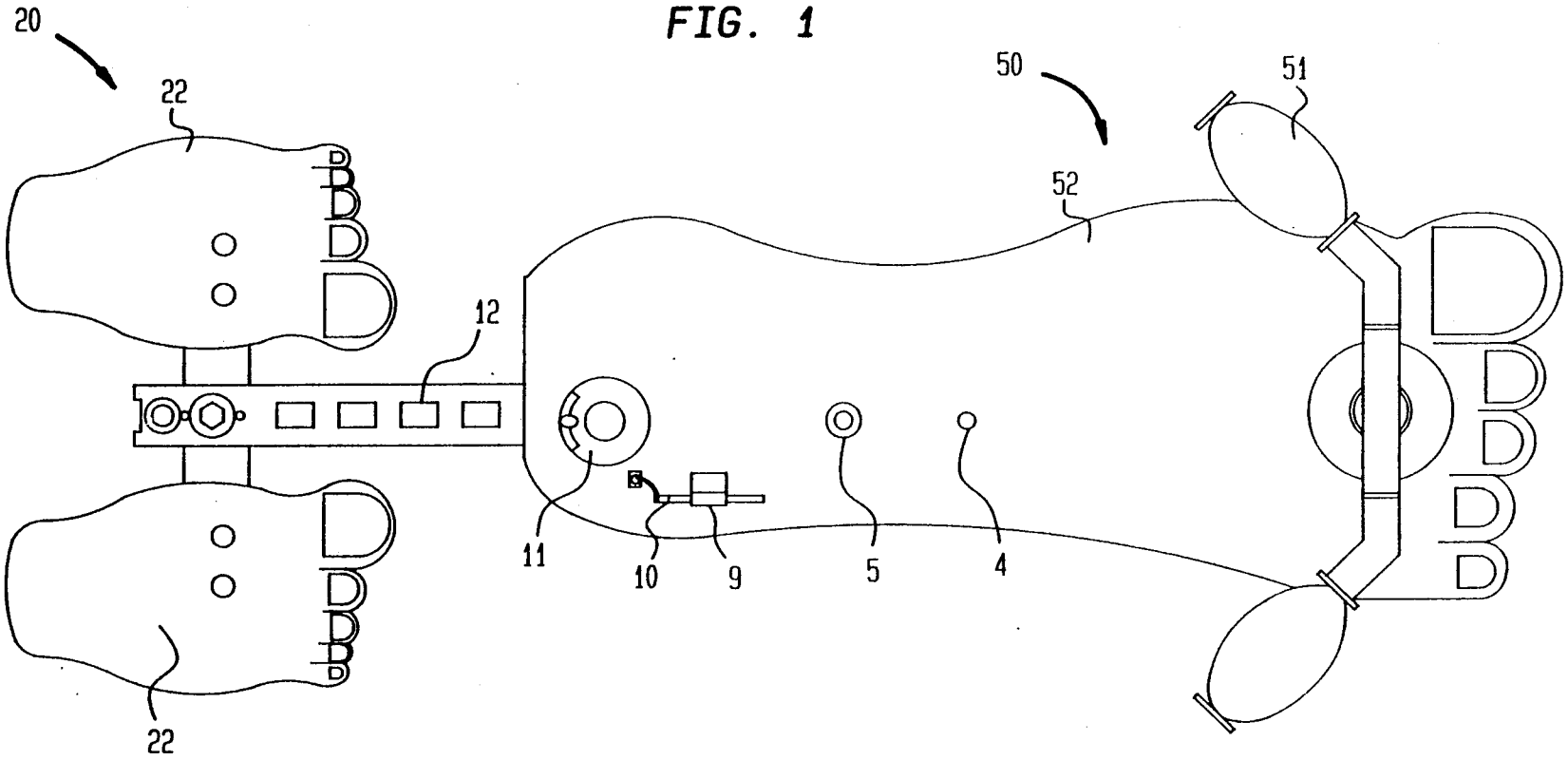
FIG. 1 is a top view showing an embodiment of the EEFP attached to a skating mobile.
Figure 2:
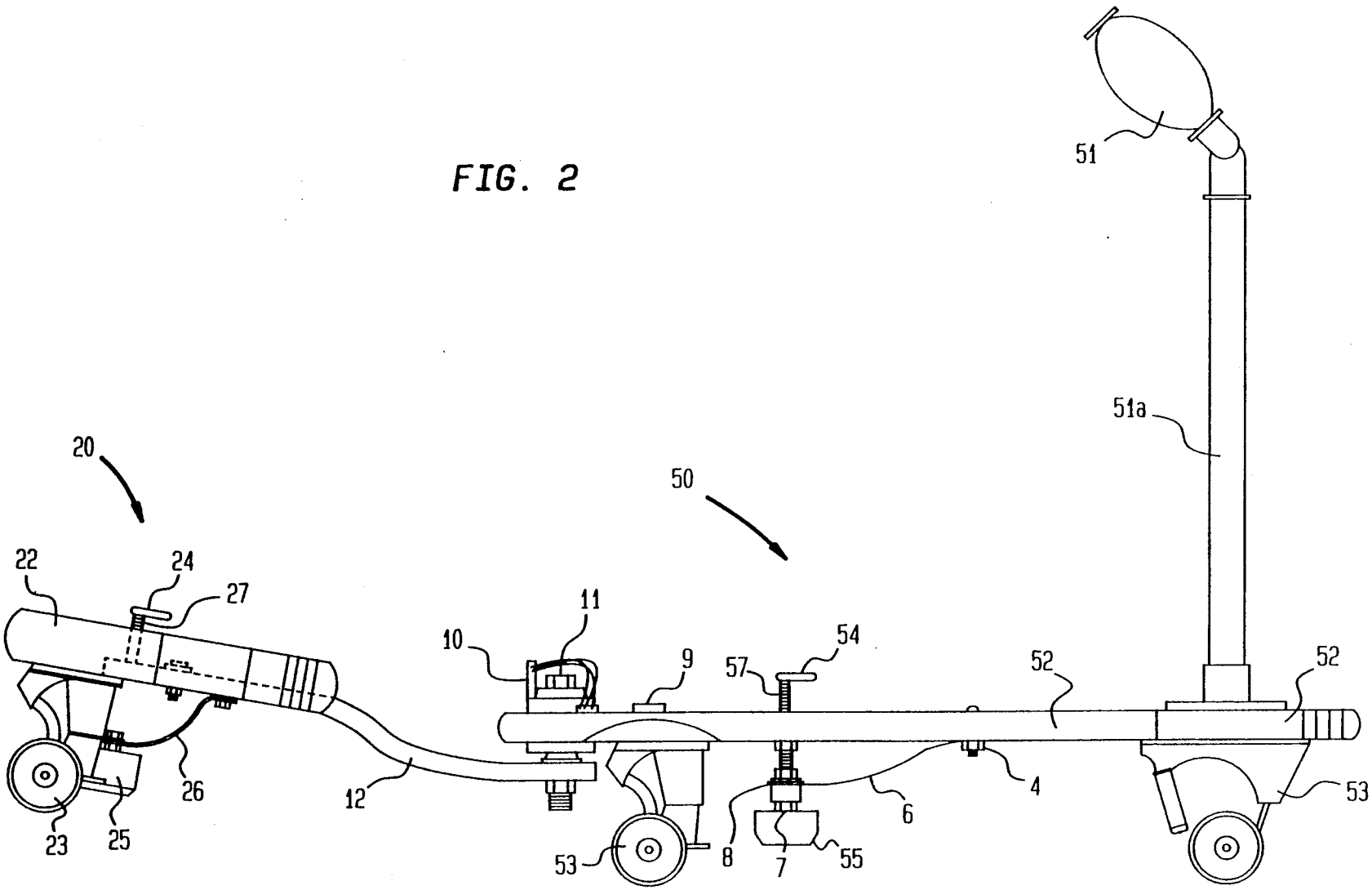
FIG. 2 is an elevational view of the embodiment of FIG. 1.

FIGS. 1 and 2 show an EEFP 20 according to the present invention pivotally connected by a pivoting pin assembly 11 to a skating mobile 50, the skating mobile comprising a standing platform 52, wheels and wheel support structure 53 and handle bars 51 supported by a suitable upstanding post 51*a*, all except for the pivotal connection 11 being conventional for skating mobiles.

The EEFP according to the present invention comprises a standing platform 22 which in the illustrated embodiment is in two parts, one part for each foot. The foot platform 22 is rigidly supported on a pivoting arm 12, the pivoting arm 12 in turn being pivotally connected through the pivot assembly 11 to the skating mobile 50. As best seen in FIG. 2, the pivoting arm 12 is bent or curved so that when all four wheels 53 of the skating mobile are in contact with the ground, the wheels 23 of the EEFP are off the ground. Consequently, it will be understood that when the user stands on the platform 22 of the EEFP, his weight brings the wheels 23 of the EEFP in contact with the ground so that the rear wheels 53 of the skating mobile contact the ground but the front wheels thereof do not contact the ground.

In normal use of the EEFP with the rider standing on the platform 22 and the wheels 23 in contact with the ground, the pivoting arm 12 and consequently the entire EEFP 20 is free to pivot about the pivot pin 11. If it is desired to use the skating mobile 50 in the conventional way, in which case the EEFP 20 will extend rearwardly from the skating mobile 50 like a tail, it is desirable to lock the EEFP in place so that it will not flop around. This is effected through the use of a pivot pin keeper 10 which is inserted through an appropriate hole adjacent the pivot pin to lock the pivoting arm 12 in place extending longitudinally from the back of the skating mobile 50. When the EEFP 20 is in use, the pivot pin keeper 10 is merely retained in a holder 9 as shown in FIG. 1.

Both the skating mobile 50 and the EEFP 20 are provided with suitable friction brakes of a similar character. As best seen in FIG. 2, the brake assembly for the skating mobile includes a friction element or brake pad 55 which is capable of being depressed downwardly by the foot to come in contact with the ground. The brake pad 55 is supported by a long metal screw that extends through the foot platform 52 and is capped at its upper end with a foot engaging element 54. A first coil spring 57 surrounds the long metal screw between the foot engaging element 54 and the platform 52. A stabilizing curve leaf spring 6 is attached by a nut and bolt 4 at one end to the underside of the platform 52 and at its other end to the long metal screw by means of two knots 7 and 8.

The brake for the EEFP is similar, again comprising a long screw capped with a foot engaging element 24 and having a friction engaging element 25 at its lower end stabilized by a leaf spring 26 and having a coil spring 27 between the foot engaging element 24 and the platform 22.

The present invention may be embodied in other specific forms without departing from the spirit or essential attributes thereof and accordingly, references should be made to the appended claims, rather than to the foregoing specification as indication the scope of the invention.

I claim:

1. A play and sports device for use with a skating mobile, comprising:

a foot platform on which to stand and coaxially disposed wheels rotatably mounted below and supported by said foot platform;

connecting means for connecting said foot platform to a rear portion of a skating mobile having a platform and front and back wheels, said connecting means including a pivot arm and pivot means for pivotably connecting said device to the skating mobile about a vertical axis so that said foot platform can pivot about said vertical axis and move in a side-to-side motion relative to a direction of travel of the foot platform; and maintaining means for maintaining said wheels of said foot platform off the ground when the front and back wheels of the skating mobile are in contact with the ground, said maintaining means including said pivot arm.

2. A play and sports device according to claim 1 wherein said pivot means is located at the connection between said pivot arm and the skating mobile.

3. A play and sports device according to claim 1 wherein said maintaining means comprises an upwardly curved or bent potion of said pivot arm.

4. A play and sports device according to claim 1 further comprising pivot pin keeping means for selectively limiting said pivot means so as to selectively prevent said pivoting of said foot platform about said vertical axis.

5. A play and sports device according to claim 1 further comprising foot brake means for stopping movement of said device, said brake means comprising an upper foot engaging element, a rod extending downwardly from said foot engaging element, a ground engaging element at a lower end of said rod, and spring means biasing said rod upwardly out of normal contact with the ground.

6. A play and sports device according to claim 5 wherein said rod passes through said foot platform and said pivot arm.

7. A play and sports device comprising a skating mobile and an extended elevated trailer pivotably connected to a rear portion of said skating mobile;

said skating mobile comprising a skate board platform carried by a set of front wheels and a set of rear wheels, a handle bar support post extending upwardly from said skate board platform at a front portion thereof, and handlebars at an upper end of said support post;

said extended elevated trailer comprising a foot platform on which to stand, and coaxially disposed wheels rotatably mounted below and supported by said foot platform;

connecting means for connecting said foot platform to a rear portion of said skating mobile, said connecting means including a pivot arm and pivot means for pivotably connecting said extended elevated trailer to said skating mobile about a vertical axis so that said foot platform can pivot about said vertical axis and move in a side-to-side motion relative to a longitudinal axis of said skating mobile; and maintaining means for maintaining said wheels of said extended elevated trailer of the ground when said front wheels and rear wheels off said skating mobile are in contact with the ground and for insuring that said front wheels of said skating mobile leave the ground when the wheels of said extended elevated trailer come in contact with the ground, said maintaining means including said pivot arm.

8. A play and sports device according to claim 7 wherein said pivot means is located at the connection between said pivot arm and said skating mobile.

9. A play and sports device according to claim 7 wherein said maintaining means comprises an upwardly curved or bent portion of said pivot arm.

10. A play and sports device according to claim 7 further comprising pivot pin keeping means for selectively limiting said pivot means so as to selectively prevent said pivoting of said foot platform about said vertical axis.

11. A play and sports device according to claim 7 wherein said extended elevated trailer further comprises foot brake means for stopping movement of said device, said brake means comprising an upper foot engaging element, a rod extending downwardly from said foot engaging element, a ground engaging element at a lower end of said rod, and spring means biasing said rod upwardly out of normal contact with the ground.

12. A play and sports device according to claim 11 wherein said rod passes through said foot platform and said pivot arm.

13. A play and sports device according to claim 7 wherein said skating mobile further comprises foot brake means for stopping movement of said device, said brake means comprising an upper foot engaging element, a rod extending downwardly from said foot engaging element, a ground engaging element at a lower end of said rod, and spring means biasing said rod upwardly out of normal contact with the ground.

14. A play and sports device according to claim 13 wherein said rod passes through said skate board platform.

* * * * *